US007325521B1

(12) United States Patent
Leiby et al.

(10) Patent No.: US 7,325,521 B1
(45) Date of Patent: Feb. 5, 2008

(54) SYSTEM AND METHOD FOR IMPROVED CAM RETARD

(75) Inventors: James Leiby, Dryden, MI (US); Robert Stein, Saline, MI (US); Tom Leone, Ypsilanti, MI (US); Lester Ryder, Grass Lake, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 11/497,694

(22) Filed: Aug. 2, 2006

(51) Int. Cl.
*F01L 1/34* (2006.01)

(52) U.S. Cl. ..... 123/90.15; 123/90.16; 123/90.17

(58) Field of Classification Search ..... 123/90.15, 123/90.16, 90.17, 90.31
See application file for complete search history.

(56) References Cited

U.S. PATENT DOCUMENTS

| | | | | |
|---|---|---|---|---|
| 2,868,187 | A * | 1/1959 | Meurer | 123/188.1 |
| 5,280,770 | A | 1/1994 | Satou et al. | |
| 5,374,244 | A | 12/1994 | Clement et al. | |
| 5,408,966 | A | 4/1995 | Lipinski et al. | |
| 5,437,253 | A | 8/1995 | Huffmaster et al. | |
| 5,495,832 | A | 3/1996 | Fujii et al. | |
| 5,746,183 | A | 5/1998 | Parke et al. | |
| 5,950,582 | A | 9/1999 | Stein | |
| 5,957,096 | A | 9/1999 | Clarke et al. | |
| 6,055,948 | A | 5/2000 | Shiraishi et al. | |
| 6,092,496 | A | 7/2000 | Bhargava et al. | |
| 6,321,731 | B1 * | 11/2001 | Russ et al. | 123/568.14 |
| 6,394,051 | B1 | 5/2002 | Filipe et al. | |
| 6,405,706 | B1 | 6/2002 | Hammoud et al. | |
| 6,488,007 | B2 | 12/2002 | Satou et al. | |
| 6,532,920 | B1 | 3/2003 | Sweetnam et al. | |
| 6,575,127 | B2 | 6/2003 | Kobayashi | |
| 6,681,741 | B2 | 1/2004 | Majima et al. | |
| 6,705,259 | B1 | 3/2004 | Sellnau et al. | |
| 6,729,304 | B2 | 5/2004 | Fujiki et al. | |
| 6,748,910 | B2 | 6/2004 | Muller et al. | |
| 6,772,731 | B2 * | 8/2004 | Miura | 123/399 |
| 6,990,938 | B2 | 1/2006 | Inomoto et al. | |
| 7,013,853 | B2 | 3/2006 | Asami et al. | |
| 7,069,909 | B2 | 7/2006 | Pozar et al. | |
| 2002/0100441 | A1 | 8/2002 | Maeda | |
| 2002/0166531 | A1 * | 11/2002 | Ackermann et al. | 123/179.16 |
| 2005/0188929 | A1 * | 9/2005 | Kawamura | 123/90.15 |

FOREIGN PATENT DOCUMENTS

JP 2004100575 A * 4/2004

OTHER PUBLICATIONS

Article, "The Combustion System of the Ford 5.4L 3-Valve Engine", Stein et al., Ford Motor Company.
SAE 960584, "Comparison of Variable Camshaft Timing Strategies at Part Load", Leone et al., International Congress & Exposition, Detroit, MI, Feb. 26-29, 1996, pp. 49-67.

(Continued)

*Primary Examiner*—Zelalem Eshete
(74) *Attorney, Agent, or Firm*—Donald J. Lewis; Allen J. Lippa

(57) ABSTRACT

A system and method to control valve timing and valve lift of an engine is described. The intake valve timing can be retarded while the valve is in a low lift or high lift mode. The method can lower engine friction and reduce fuel consumption, at least under some conditions.

19 Claims, 6 Drawing Sheets

OTHER PUBLICATIONS

SAE 950975, Abstract, "Dual equal VCT—A variable camshaft timing strategy for improved fuel economy and emissions", Stein et al., International Congress & Exposition, Detroit, MI, Feb. 27-Mar. 2, 1995.

SAE 950975, "Dual Equal VCT—A Variable Camshaft Timing Strategy for Improved Fuel Economy and Emissions", Stein et al. International Congress and Exposition, Detroit, MI, Feb. 27-Mar. 2, 1995.

* cited by examiner

SYSTEM AND METHOD FOR IMPROVED CAM RETARD

FIELD

The present description relates to a system and method for controlling an engine having at least a variably actuated valve. The valve lift and phase may be adjusted in response to engine operating conditions.

BACKGROUND

One method to adjust engine valve timing is described in U.S. Pat. No. 6,321,731. This patent describes simultaneously adjusting retarded intake and exhaust valves during engine operation to alter engine breathing characteristics. Intake valve closing timing delay makes it necessary to increase the intake manifold pressure to achieve a desired load. As a result, engine pumping work and fuel consumption are reduced. In addition, engine expansion work is increased by late exhaust valve opening timing and engine emissions are reduced by late exhaust valve closing timing.

While it may be beneficial to operate an engine with retarded intake and exhaust valve timing, it can also lead to a rougher running engine during some conditions. For example, if an engine is operated at idle where engine speed is relatively low, exhaust gas residuals can reduce the burn rate and combustion stability can degrade. The slower burn rate may be attributed to intake and exhaust valve overlap along with the "internal EGR" increase that results from late exhaust valve closing. Consequently, engine operation at idle may be degraded if intake and exhaust valve timing is retarded. On the other hand, the further the intake and exhaust valve timing is advanced, the less emissions and fuel consumption benefit may be realized.

SUMMARY

One embodiment of the present description includes a system for regulating flow to a cylinder of an internal combustion engine, the system comprising: a valve operating mechanism capable of opening at least one intake valve at an crankshaft angle that is after top-dead-center, relative to an intake stroke of a cylinder, said intake valve opening position also being in advance of a closing of an exhaust valve in said cylinder; and a cam profile switching device that is capable of changing the amount of valve lift produced by said valve operating mechanism.

An internal combustion engine system that includes variably retarded valve timing and cam profile switching can provide improved idle quality by improving cylinder charge mixing and cylinder burn rate. For example, a low lift intake valve cam profile can be used with retarded valve timing at partial engine loads to reduce the effective valve overlap and to increase the velocity of air moving from the intake manifold to the cylinder. The low lift intake valve cam profile can reduce the amount of gas exchanged between intake and exhaust manifolds during the valve overlap period. Delayed intake valve opening allows the cylinder piston to move farther through the stroke before the intake valve is opened. This increases the piston velocity and increases flow into the cylinder, thereby improving the mixing of gases in the cylinder. As a result, the cylinder burn rate increases and the intake manifold pressure can be increased to reduce engine pumping work.

The present description may provide several advantages. For example, the approach may be used to improve engine emissions, improve engine idle quality, and reduce engine pumping work. Furthermore, engine full load performance can be improved by selecting a higher lift cam profile with less retarded valve timing to improve engine breathing at higher engine speeds and loads.

The above advantages and other advantages, and features of the present description will be readily apparent from the following detailed description of the preferred embodiments when taken alone or in connection with the accompanying drawings.

BRIEF DESCRIPTION OF THE DRAWINGS

The advantages described herein will be more fully understood by reading an example of an embodiment, referred to herein as the Detailed Description, when taken alone or with reference to the drawings, wherein.

DETAILED DESCRIPTION

Figure 1:
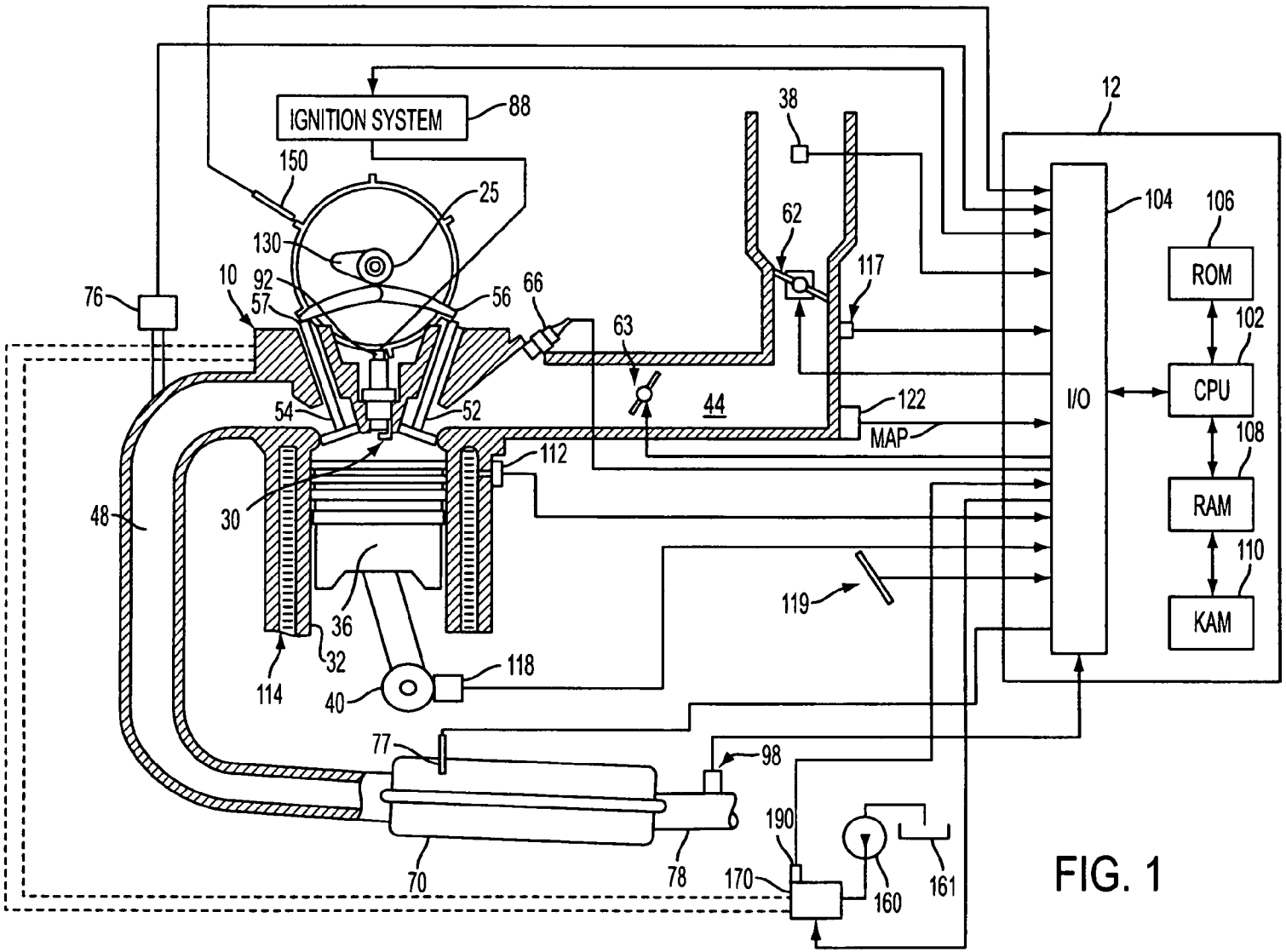
FIG. 1 is a schematic diagram of an engine.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40. Combustion chamber 30 is known communicating with intake manifold 44 and exhaust manifold 48 via respective intake valve 52 and exhaust valve 54. Cam phase actuator 25 is shown coupled to camshaft 130. Oil reservoir 161 supplies oil to pump 160, pressurized oil is supplied from the pump to cam phase actuator 25 via valve 170 based on commands from engine controller 12. Camshaft 130 is constructed with at least two intake cam lobe profiles and at least one exhaust cam lobe profile. Alternatively, the system may utilize separate intake and exhaust cams. The intake cam lobe profiles include a lower lift profile and a higher lift profile. Intake valve rocker arm 56 and exhaust valve rocker arm 57 transfer valve opening force from the camshaft to the respective valve stems. Intake rocker arm 56 includes a lost motion member for selectively switching between lower and higher lift cam lobe profiles. A hydraulically actuated pin selectively couples the rocker arms together activating or deactivating the higher lift cam profile. Alternatively, different valvetrain actuators and designs may be used in place of the design shown (e.g., pushrod instead of over-head cam, electro-mechanical instead of hydro-mechanical).

Intake manifold 44 is also shown having fuel injector 66 coupled thereto for delivering liquid fuel in proportion to the pulse width of a signal from controller 12. Fuel is delivered to fuel injector 66 by fuel system (not shown) including a fuel tank, fuel pump, and fuel rail (not shown). Alternatively, the engine may be configured such that the fuel is injected directly into the engine cylinder, which is known to those skilled in the art as direct injection. In addition, intake manifold 44 is shown communicating with optional electronic throttle 62.

Distributorless ignition system 88 provides ignition spark to combustion chamber 30 via spark plug 92 in response to controller 12. Universal Exhaust Gas Oxygen (UEGO) sensor 76 is shown coupled to exhaust manifold 48 upstream of catalytic converter 70. Alternatively, a two-state exhaust gas oxygen sensor may be substituted for UEGO sensor 76. Two-state exhaust gas oxygen sensor 98 is shown coupled to exhaust pipe 78 downstream of catalytic converter 70. Alternatively, sensor 98 can also be a UEGO sensor. Catalytic converter temperature is measured by temperature sensor 77, and/or estimated based on operating conditions such as engine speed, load, air temperature, engine temperature, and/or airflow, or combinations thereof.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104, read-only memory 106, random-access memory 108, keep-alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 119 coupled to an accelerator pedal; a measurement of engine manifold pressure (MAP) from pressure sensor 122 coupled to intake manifold 44; humidity from humidity sensor 38; a measurement (ACT) of engine air temperature or manifold temperature from temperature sensor 117; and an engine position sensor from a Hall effect sensor 118 sensing crankshaft 40 position. In a preferred aspect of the present description, engine position sensor 118 produces a predetermined number of equally spaced pulses every revolution of the crankshaft from which engine speed (RPM) can be determined.

Figure 2A:
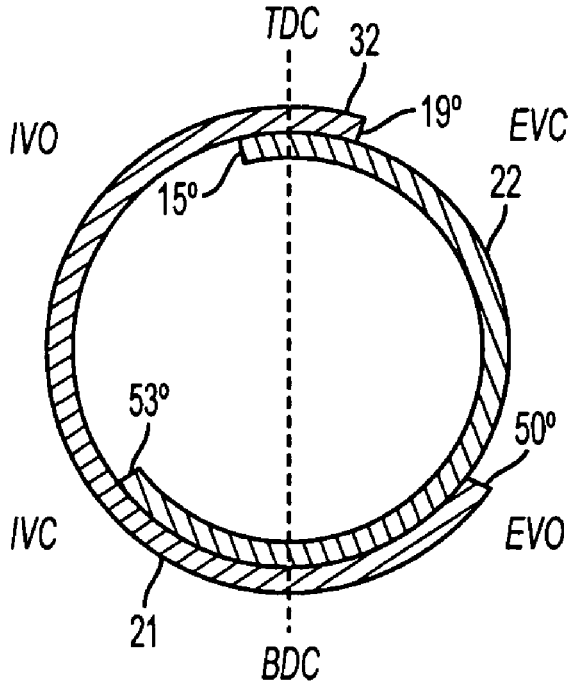
FIG. 2A is an exemplary diagram showing the valve overlap and valve timing of an engine with nominal fixed valve timing.

Referring now to FIG. 2A, an exemplary diagram of nominal valve overlap and valve timing for an engine is shown. Exhaust valve open timing is represented by the outer ring 21. Intake valve open timing is represented by the inner ring 22. The valve timings are referenced to cylinder positions top-dead-center (TDC) and bottom-dead-center (BDC). Notice, the valve overlap period from intake valve opening (IVO) to exhaust valve closing (EVC) is roughly centered around TDC. Intake valve closing (IVC) and exhaust valve opening (EVO) are roughly centered around BDC. These valve timings may be set to provide a compromise between engine performance, emissions, and fuel economy throughout the engine operating range.

Figure 2B:
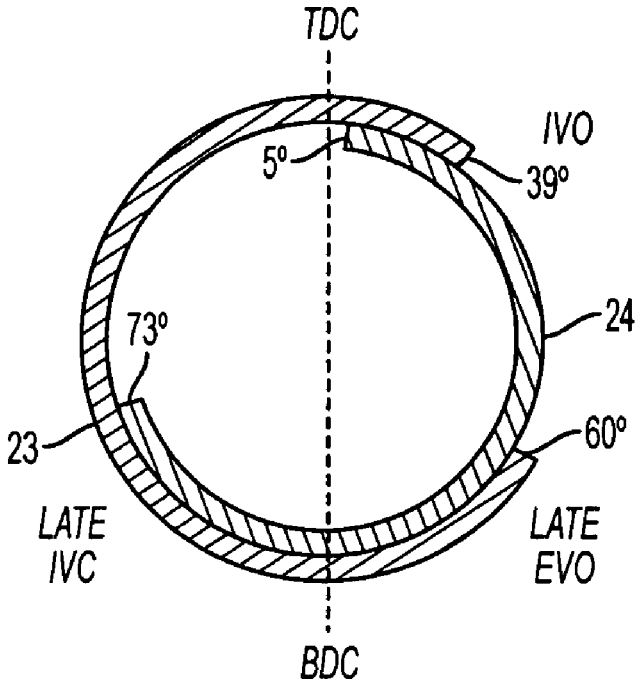
FIG. 2B is an exemplary diagram showing valve overlap and valve timing for an engine with adjustable intake and exhaust valve timing, cam position phase is adjusted to a retarded position.

Referring to FIG. 2B, an example diagram of retarded engine valve timing is shown. In one example, the valve overlap and valve timing can be adjusted to the illustrated timings using dual equal valve timing control (i.e., exhaust valve timing and intake valve timing are adjusted together by substantially equal amounts). As engine operating conditions vary, the amount of valve timing retard can be varied. For example, retarded intake valve opening locations may occur within the range of −10, −5, 0, 5, 10, 15, 20, 25, 30, 35, 40, or 45 degrees after TDC intake stroke of a respective cylinder (the minus sign indicates before TDC and intermediate angles between the above-mentioned angles are also possible). In one example, the intake valve opening is varied from slightly (e.g., 10 crankshaft angle degrees) before top-dead-center of the intake stroke to 45 crankshaft angle degrees after top-dead-center of the intake stroke. The valve timing is varied to alter the engine pumping losses, expansion work, emissions, and the in-cylinder exhaust gas recirculation (EGR). Retarded valve timing allows more time for combusted gases to expand, thereby increasing the engine work. In addition, later IVC and EVC timing can be used so that the intake manifold pressure has to be increased for the engine to produce the same output. Higher intake manifold pressure reduces the engine pumping work and can therefore improve fuel economy.

On the other hand, the benefits of retarded valve timing can be limited during some conditions. For example, for an engine having a single intake cam profile, the profile is often a compromise between idle stability and fuel consumption at lower engine speeds versus engine performance at higher speeds and loads. When a fixed lift cam is retarded to improve part load engine operation, the amount of cam retard can be limited by combustion stability. That is, if the cam is retarded beyond a certain amount, the engine emissions, engine noise, and engine vibration may degrade as cylinder conditions cause characteristics of combustion (e.g., temperature, pressure, air-fuel mixing, and burn rate) to vary. By providing different valve lift profiles for different operating conditions, it is possible to increase the amount of cam retard during part load engine operating conditions. The lower lift cam profile can improve combustion stability and reduce engine emissions at lower engine speeds because the cylinder air-fuel charge is mixed better and combusts more uniformly. Further, the lower lift cam profile provides a way to reduce the effective overlap between the intake valve and the exhaust valve even though the exhaust lobe and the intake valve lobe may be driven on the same camshaft.

In another example, the valve timing can be adjusted individually for intake and/or exhaust valves (dual independent cam timing) to achieve the illustrated timing. This type of system allows the intake and exhaust valve timing to be retarded while valve overlap can be set positive (i.e., the intake and exhaust valve are simultaneously open) or negative (i.e., no overlap between the valves).

In yet another example, exhaust valve timing may be fixed while intake valve timing is adjustable (intake only cam timing) to the illustrated timing.

Returning to FIG. 2B, the exhaust valve open timing is represented by outer ring 23. Intake valve open timing is represented by inner ring 24. As mentioned above, the valve timings are referenced to cylinder positions top-dead-center (TDC) and bottom-dead-center (BDC). Notice, that the valve overlap period from intake valve opening (IVO) to exhaust valve closing (EVC) is centered after TDC, at roughly 22 crankshaft angle degrees after top-dead-center (ATDC). Intake valve closing (IVC) and exhaust valve opening (EVO) are centered after BDC, at roughly 21 crankshaft angle degrees after bottom-dead-center (ABDC).

As mentioned above, it is possible to switch between lower lift and higher lift intake cam lobe profiles when using the illustrated cam phasing.

The valve timing shown in FIG. 2B is one example of retarded intake and exhaust valve timing. Accordingly, alternate intake and exhaust valve timings are possible that may provide a compromise between performance and fuel economy throughout the engine operating range. For example, retarded intake valve opening locations may occur within the range of 10 degrees before TDC to 45 degrees after TDC intake stroke of a respective cylinder. While retarded exhaust valve closing locations may occur within the range of 0 to 65 degrees after TDC intake stroke of a respective cylinder (intermediate angles between the above-mentioned intake and exhaust timing angles are also possible). Combinations and sub-combinations of intake opening and exhaust valve closing locations may be used to achieve a desired emission, fuel economy, and/or performance level. As such, the illustration is not meant to limit the breadth or scope of this disclosure.

Also note that the valve opening duration may be different between the lower lift cam profile and the higher lift cam profile. For example, the lower lift cam lobe may increase or decrease the valve opening duration with respect to the higher lift cam lobe. That is, the lower lift cam lobe may open the intake valve for 248 crankshaft degrees while the higher lift cam lobe may open the intake valve for 255 crankshaft degrees, for example. In addition, there may be a phase difference between the lower and higher lift cam lobes. In other words, the lower lift cam lobe may be built to open sooner or later, with respect to a crankshaft position, than the higher lift cam lobe while the cam phase adjusting mechanism is in a stationary position. Any of the above cam profiles, or combinations and/or sub-combinations thereof, may be used with the method described in FIG. 4.

Figure 3:
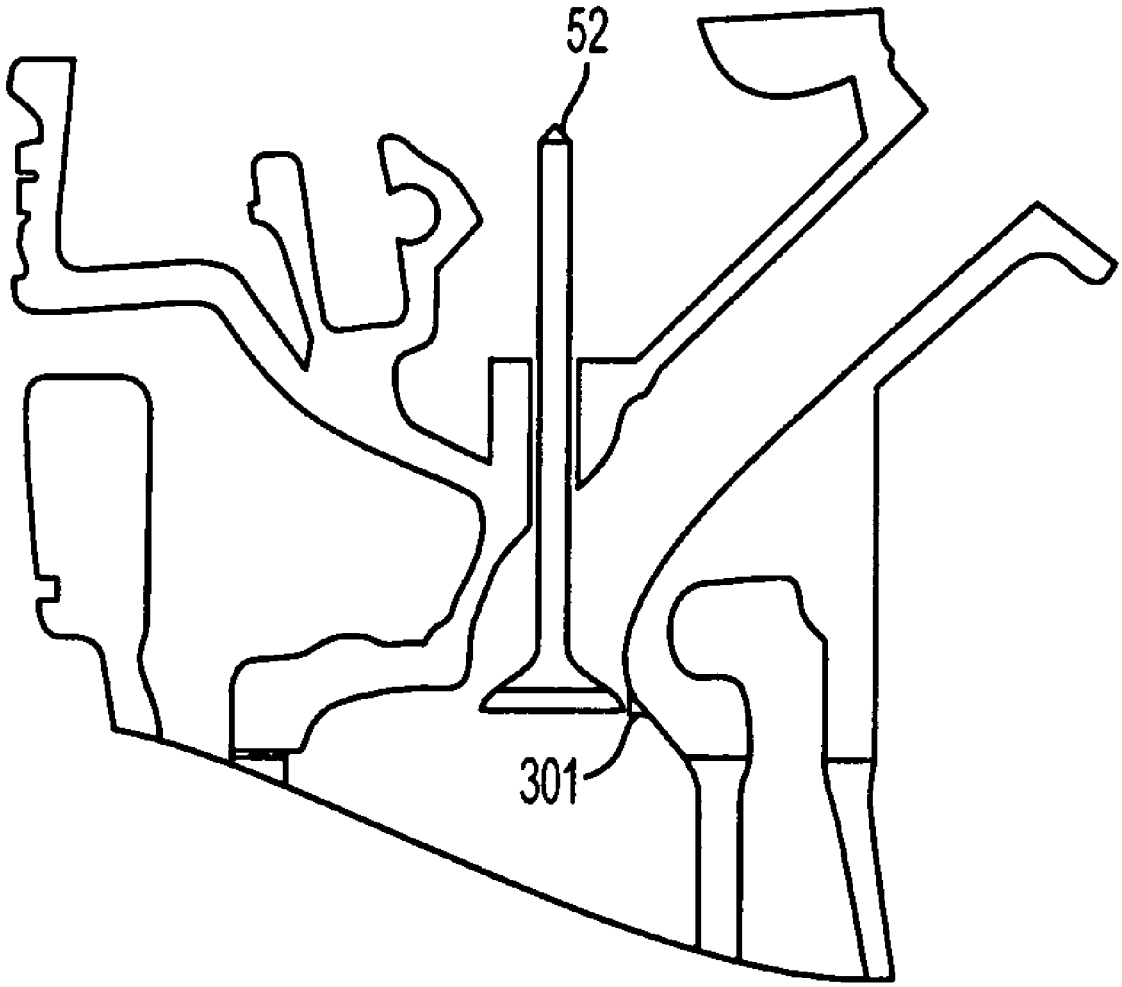
FIG. 3 is a schematic diagram of a cylinder intake port and intake valve mask.

Referring now to FIG. 3, the intake port and valve of an engine are illustrated. Intake valve 52 is shown in a partially open position where the valve face is slightly below the valve mask 301. The valve mask height is set at a level that provides a compromise between enhanced lower load cylinder mixing and burn rate versus higher load engine performance. By combining cam profile switching with a valve mask, the valve mask height can be reduced while lower load cylinder mixing and higher load performance are both improved. When the intake cam profile is set to the lower lift position, the valve mask increases turbulence in the cylinder. Lower valve lift allows the intake valve mask height to be lowered while maintaining or improving mixing and burn rate. At higher cylinder loads, the cam profile can be set to the higher lift position so the reduced valve mask height is even less of a restriction to air entering the cylinder. In one example, the valve mask height can be reduced by roughly 50% when cam profile switching is combined with a valve mask. This improves the engine volumetric efficiency at higher engine speeds and loads.

Variable cam timing combined with valve masking and cam profile switching allows the charge entering the cylinder (i.e., air or air-fuel mixture) to be timed so that the piston velocity affects the charge motion and the burn rate. Further, when the intake valve timing is retarded from top-dead-center of the intake stroke the combination can be used to improve fuel economy, engine emissions, performance at higher loads, idle quality, and engine vibration.

Figure 4:
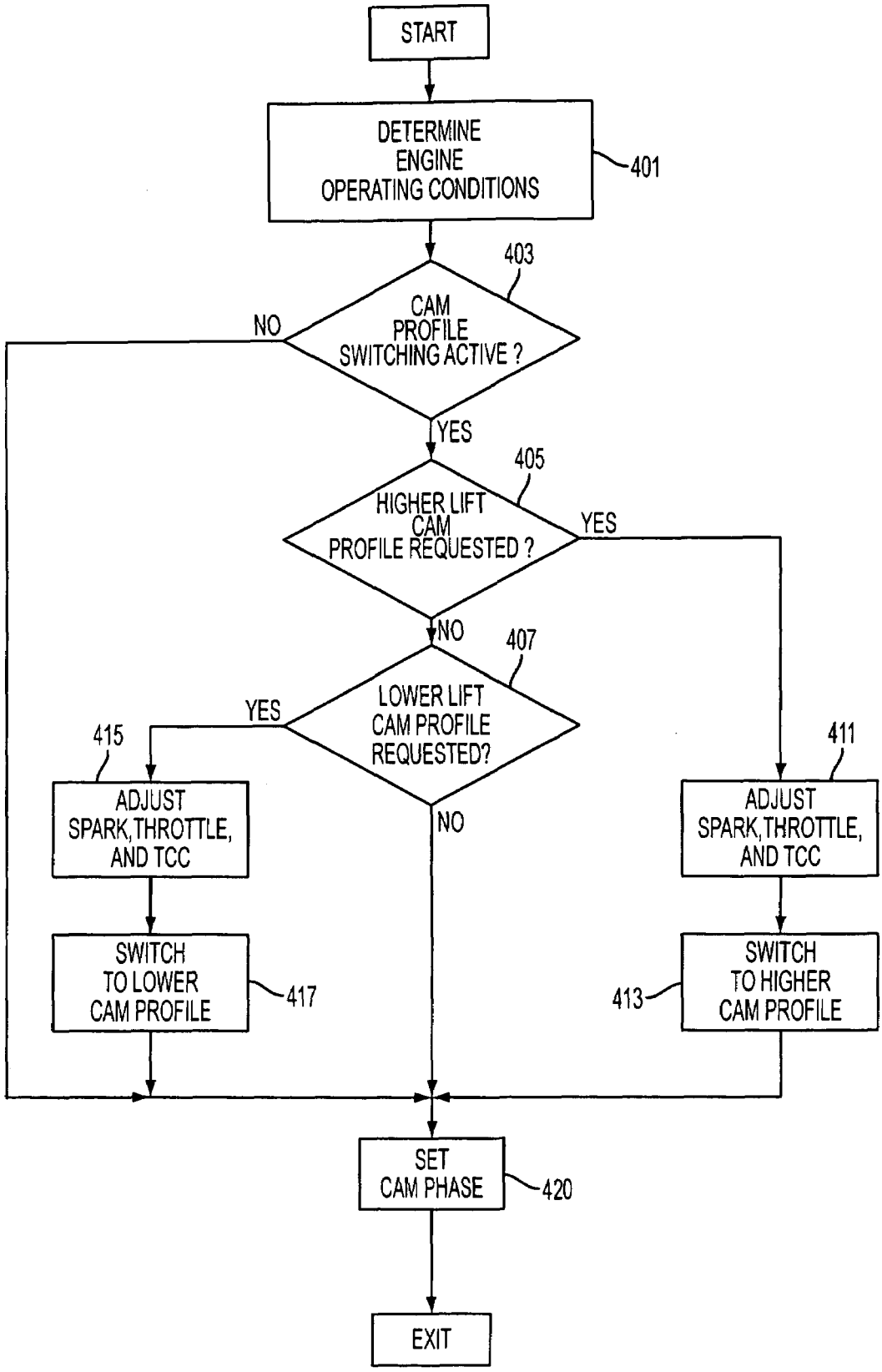
FIG. 4 is an example flow diagram showing a control strategy for an engine with cam profile switching and retarded valve timing.

Referring now to FIG. 4, a flow chart of an example control strategy for an engine with cam profile switching and variable cam timing is shown. In step 401, engine operating conditions are determined. Engine operating conditions may include engine oil temperature, engine temperature, engine oil pressure, barometric pressure, humidity, engine speed, engine demand torque, and engine cylinder air charge. After determining operating conditions, the routine proceeds to step 403.

In step 403, the routine determines if the cam profile switching system is ready to be operated. If not, the routine proceeds to step 420. If so, the routine proceeds to step 405. The cam profile default position is the low lift cam profile. This position was selected as the default position because it provides improved starting characteristics compared to the high lift position.

Cam profile switching is activated in step 403 after a series of logical conditions are met. For example, cam profile switching may not be activated until a certain engine oil pressure is achieved. Furthermore, various combinations and sub-combinations of engine operating conditions may be logically combined to determine if cam profile switching should be permitted. For example, engine oil pressure may be combined with lower engine temperature and with sufficient time to flush air bubbles out of the system, to determine if profile switching should be allowed. Further, diagnostics may be performed to verify operation of the profile switching mechanism. If engine operating conditions and switching system conditions are met, the routine proceeds to step 405.

Figure 5A:
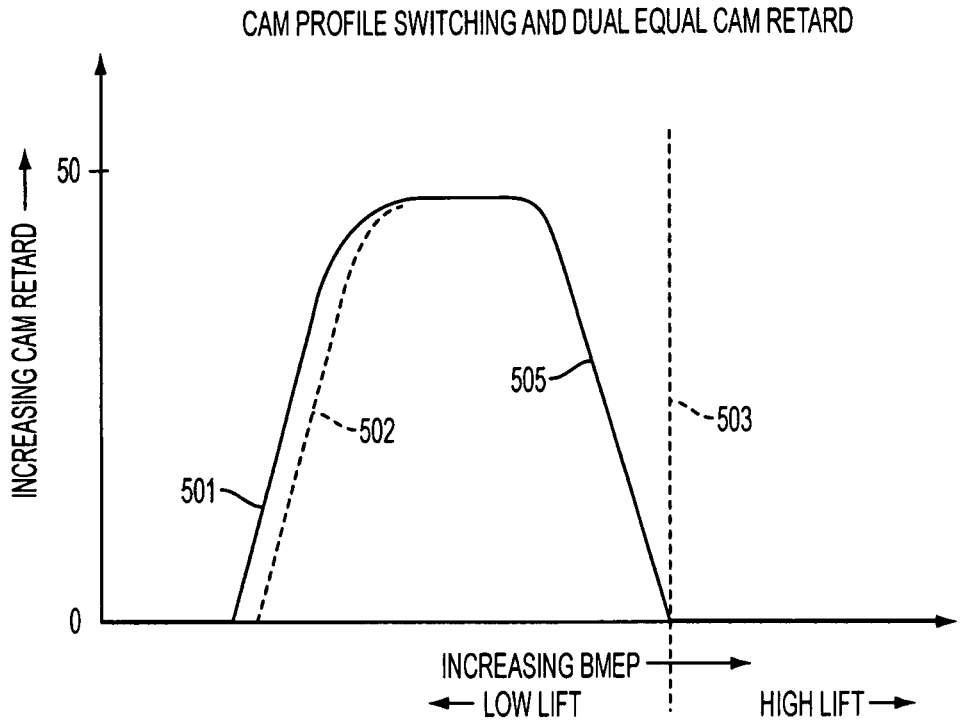
FIG. 5A is a plot showing an example cam retard and switching schedule for an engine having cam profile switching and variable cam timing.
Figure 5B:
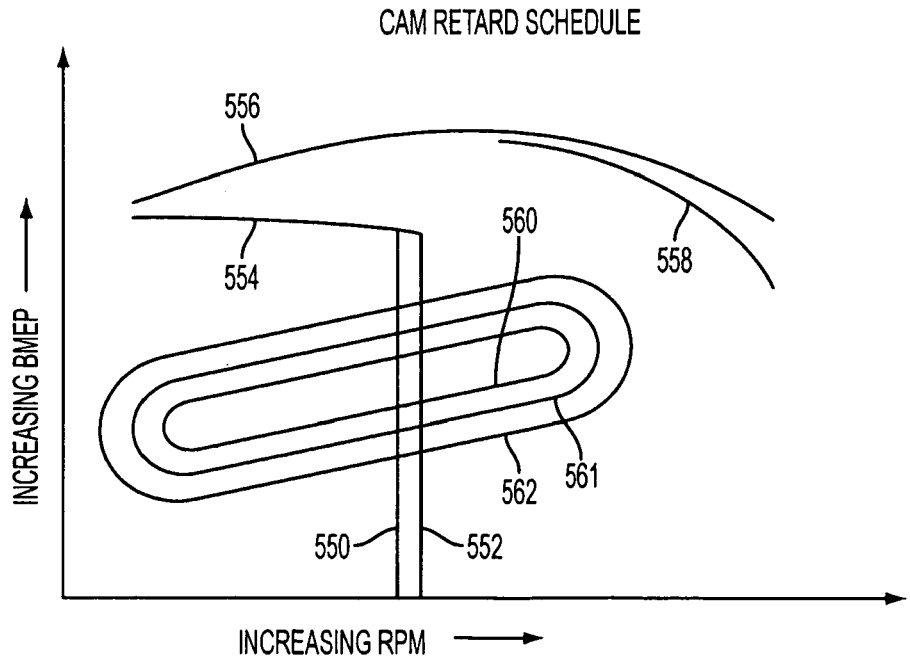
FIG. 5B is an example plot showing the relationship between engine speed and load relative to cam phase and cam profile.

In step 405, the routine determines if the system should switch to a higher lift cam profile. This determination may be made in response to the current and/or anticipated engine speed and load, for example. Switching boundaries or points may be empirically determined and described in tables or functions. Operating conditions may be used to index data in these functions or tables to determine whether or not to switch to the higher lift cam profile. Example switching schedules are illustrated in FIGS. 5A and 5B. The data retrieved from these tables or functions can be used to logically determine when to change to the higher lift cam profile. If operating conditions are interpreted to find that a change to the higher lift profile is desired, the routine proceeds to step 411. If not, the routine proceeds to step 407.

In step 407, the routine determines if the system should switch to a lower lift cam profile. Similar to step 405, lower lift cam switching boundaries can be stored in functions or tables. If operating conditions are interpreted to find that a change to the lower lift profile is desired, the routine proceeds to step 415. If not, the routine proceeds to step 420.

Note that the lower and higher cam lift boundaries may be different so that hysteresis is present between switching events. For example, when engine speed is increasing, the system may switch from the lower lift cam profile to the higher lift cam profile at 3000 RPM. Then, when the engine speed is decreasing, the system may switch from the higher lift cam profile to the lower lift cam profile at 2500 RPM.

In step 420, the engine cam phase is set. The cam phase is the cam position relative to the crankshaft position. The cam has a base position that may be maintained by holding the cam in position with a hydraulically actuated mechanical locking pin, for example. Depending on the system design, the cam may be advanced and/or retarded from the base position.

The desired cam phase can be determined from one or more of the above engine operating conditions and from the current state of the cam lift profile. In other words, if the cam is set to a lower profile, the cam phase can be set to one position. If the cam is set to the higher profile, the cam phase can be set to a different position. Typically, the cam position is determined by accessing one or more arrays of empirically determined cam positions. The cam is commanded to the desired position and the routine exits.

In step 415, engine spark, throttle position, and torque converter clutch may be adjusted to prepare for an impending cam profile switch. When switching from the higher lift cam profile to the lower lift cam profile there may be a change in engine torque because the lower lift cam profile may make the intake valve restriction greater for air entering the cylinder. This condition may be compensated by adjusting the engine spark and/or throttle position. The throttle plate can be opened so that the increased manifold pressure overcomes an increased valve restriction and so that cylinder air charge is substantially maintained (e.g., within ±0.15 cylinder load) during the transition. The cylinder torque can also be compensated by adjusting the cylinder spark. The spark may be retarded from the value it was at prior to the transition, but then it may be advanced during the transition if the engine speed changes by more than a predetermined amount, for example. In this way, engine speed can be used as feedback to advance or retard the spark, thereby controlling the engine torque.

Changes in engine torque that may occur during cam profile mode switching can also be mitigated by adjusting the torque converter clutch slippage. Prior to a profile transition, the torque converter clutch command may change the duty cycle or current applied to the torque converter lockup clutch so that the clutch slippage is increased. The torque converter slip is increased so that there is less possibility that the operator will notice any change in engine torque. If the converter is already slipping prior to the mode transition, the current slip amount may be maintained. See the FIG. 6B, for example.

In step 417, the cam profile is switched to the lower lift position. The cam profile position may be changed by releasing a hydraulically actuated pin that allows the higher lift cam profile to be activated. The pin can be released while the rocker arm is following the base circle portion of the cam. In this position, the force between the valve actuating members is significantly reduced. This allows a smooth transition between actuating members.

In step 411, engine spark, throttle position, and torque converter clutch may be adjusted. The adjustments in this step are made to compensate for the torque increase that may be accompanied by switching from the lower lift cam profile to the higher lift cam profile. When the cam lift is increased there is a potential for the engine torque to increase because the intake valve may provide less of a restriction to air entering the cylinder. When the valve restriction is reduced, more air may flow into the cylinder. A torque change may be mitigated by reducing the throttle opening amount and/or by retarding the spark. Similar to step 415, the spark may be feedback controlled in response to engine speed, so that engine torque changes are less noticeable to the operator.

The torque converter clutch slip may also be adjusted in step 411. If the torque converter is locked or if there is a small amount of slip, the slip may be increased to reduce driver perception of cam mode switching. The decision and action to change slip are made prior to issuing the cam profile switch command. The routine proceeds to step 413.

In step 413, the cam profile switch is set to the higher lift position. Similar to step 417, the higher lift cam profile pin is engaged when the intake valve rocker arm is following the base cam circle. This allows the cam profile pin to engage the higher lift mechanism when there is little force difference between the valve actuator members. The routine proceeds to step 420.

Also note that other methods may be used in steps 415 and 411 to mitigate torque changes that may result from cam profile switching. For example, if an electronic throttle is not available, engine torque changes may be mitigated by spark only, or by spark and by adjusting a bypass air valve for example.

Referring now to FIG. 5A, a plot of an example cam retard schedule for a system having dual equal cam retard is shown. The x-axis represents increasing engine load expressed in terms of brake mean effective pressure (BMEP). The y-axis represents increasing cam retard relative to top-dead-center intake stroke. Vertical line 503 represents an engine load where the cam profile may be transitioned from a lower lift amount to a higher lift amount. Curve 501 represents an empirically determined amount of cam retard for an engine having dual equal variable camshaft timing. This curve is usually limited by combustion stability. Cam timing for an engine without cam profile switching is represented by curve 502. A comparison between curves 501 and 502 indicates that an engine with cam profile switching can operate at lower engine loads with increased cam retard. This can improve engine fuel economy while decreasing engine emissions. Curve 505 represents the manifold pressure constrained cam retard. Since some engine systems rely on manifold vacuum (e.g., vehicle brakes), it can be desirable to constrain the cam retard so that a desired level of manifold vacuum is observed during higher torque demand conditions. This limitation is described by curve 505.

Referring now to FIG. 5B, a plot of an example cam switching and cam retard schedule is shown. The x-axis represents engine speed while the y-axis represents engine BMEP. Curve 556 represents the full load engine curve. Curve 554 represents the load boundary for cam profile switching between higher and lower lift cam profiles at lower engine speeds. For example, the higher profile cam is engaged for engine loads that are greater than the curve. The lower profile cam is engaged when engine loads are below the curve. Alternatively, cam profile switching may only be a function of engine speed, if the lower lift profile allows sufficiently high load at low engine speed. Lines 550 and 552 represent cam switching boundaries that are made in response to engine speed. Line 552 is a boundary used when engine speed is increasing and line 550 is a boundary for when engine speed is decreasing. The two boundaries provide hysteresis for reducing undesirable frequent profile switching.

Curves 560, 561, 562, and 558 represent various levels of cam retard in the engine operating range. Curve 558 is a boundary where between 10 and 20 Crankshaft angle degrees of cam retard is added for the region between curve 558 and curve 556. Curve 562 identifies where the cam retard begins for part load engine operation. The area outside of curve 562 represents 0 crankshaft angle degrees of cam retard. Curve 561 represents 25 crankshaft angle degrees of cam retard. In the area between curve 562 and curve 561 the cam retard is gradually changed, by interpolation for example. Curve 560 represents the 50 crankshaft angle degree boundary. The area inside of curve 560 represents 50 crankshaft angle degrees of cam retard. Between curve 560 and curve 561 cam retard is also gradually changed so that a smooth transition is provided between curves.

Thus, FIGS. 5A and 5B illustrate that an engine having dual equal variable valve timing can be operated to vary cam retard and the state of a cam profile switching device with engine speed and/or load. In this configuration, the exhaust valve closing timing may be after the intake valve opening timing while the intake valve opening is after top-dead-center of the intake stroke.

Note that the curves shown in FIGS. 5A and 5B are made for illustration purposes only and are not meant to limit the scope or breadth of this description. The cam switching and cam retard profiles may be modified as desired to suit a particular engine system.

Figure 6A:
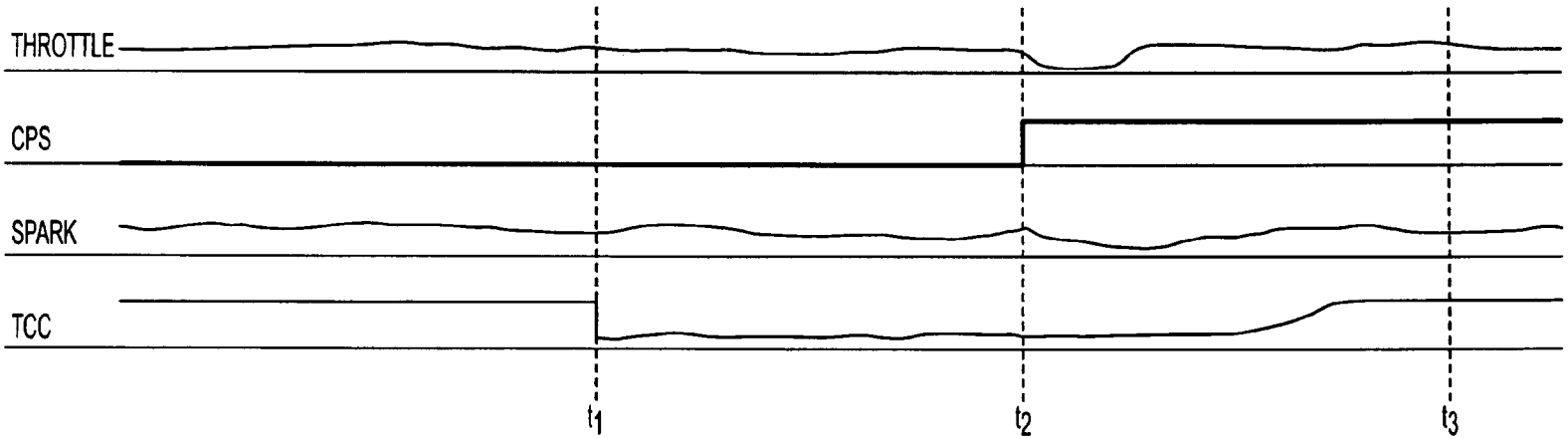
FIG. 6A is an example transition sequence of selected actuators for moving from a lower lift profile cam to a higher lift profile cam.

Referring now to FIG. 6A, an example transition sequence of selected actuators for transitioning from a lower lift cam to a higher lift cam is shown. The sequence begins at vertical marker $t_1$. When a cam profile transition is requested, the current level of torque converter slip is assessed. If the current slip amount will mitigate driveline torque disturbances to a desired level, the current amount of slip is maintained. If the current amount of slip will not mitigate driveline disturbances to a desired level, the converter clutch slip is increased. The torque converter clutch slip is adjusted in an effort to make a compromise between fuel economy and the operator's perception of driveline torque disturbances.

At vertical marker $t_2$, the cam profile switching (CPS) mechanism is commanded to the higher lift cam profile. The cam profile switch for each cylinder is locked into position as the individual rocker arms encounter the cam's base circle. Consequently, the valves are not simultaneously locked into the higher lift position. Furthermore, since the mechanisms are engaged while the rocker arm is following the cam's base circle, the valve lift adjustments are made sequentially and are slightly delayed. The engine throttle position is also changed at $t_2$. Specifically, the throttle opening is decreased and the spark is retarded. By decreasing the throttle opening the manifold pressure can be lowered. Consequently, the cylinder can induct substantially the same amount of air even though the valve lift and/or opening duration may change. In addition, the spark can be retarded at $t_2$. As described by FIG. 4, the amount of spark can be controlled in response to the engine speed error during the cam profile transition. Thus, the cylinder air amount and spark can be controlled so that changing the cam profile has a less noticeable effect on engine torque production.

The cam profile transition is completed at $t_3$. Thereafter, the throttle position is based at least on the driver torque demand and the higher lift cam profile.

Figure 6B:
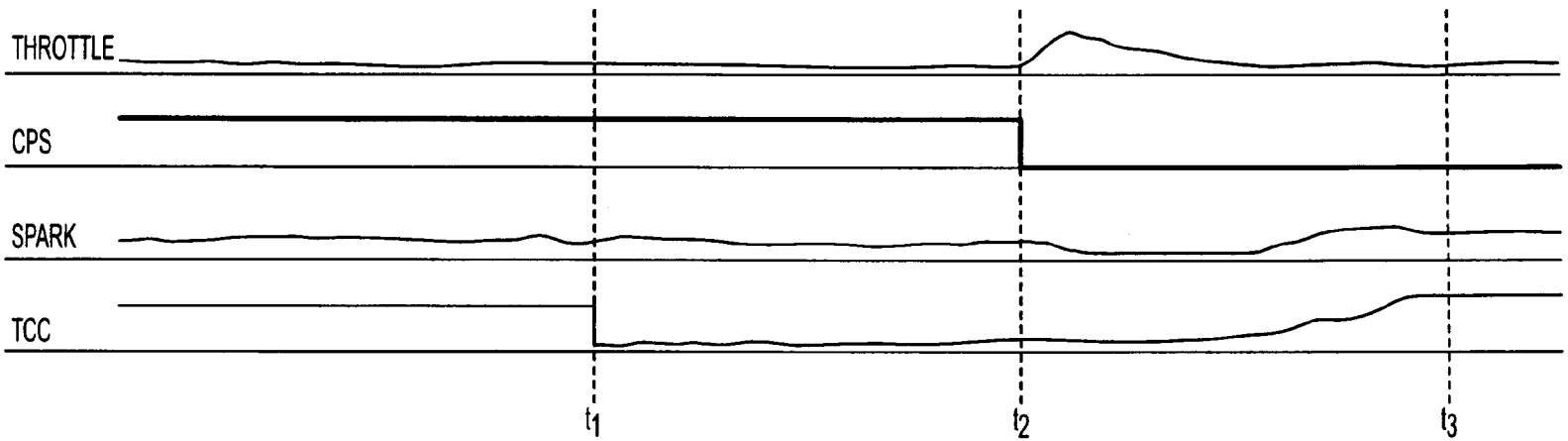
FIG. 6B is an example transition sequence of selected actuators for moving from a higher lift profile cam to a lower lift profile cam.

Referring now to FIG. 6B, an example transition sequence of selected actuators for transitioning from a higher profile cam to a lower profile cam is shown. The transition begins at $t_1$ where control logic determines that a change in the cam profile is desired. The torque converter slip is adjusted to mitigate the operator's perception of a driveline torque disturbance. Typically, the torque converter slip is maintained or increased.

At $t_2$ the rocker arm locking pins are commanded to the unlocked position. The pins remain in the locked position for each cylinder until the individual rocker arm is following the cam's base circle. Thus, the higher lift cam profile is sequentially released. The throttle opening can also be increased at this time, and the spark may be retarded. The throttle is opened to increase the intake manifold pressure so that a substantially equivalent amount of air is inducted into the cylinder. The spark may be retarded to compensate for variations in the cylinder air charge amount that may result from the throttle position adjustment. Spark and/or throttle may also be adjusted before the rocker arm locking pins are unlocked, to increase manifold pressure in preparation for the decrease in valve lift.

The cam profile transition is completed by t3. After this point, the throttle position is based at least on the driver torque demand and the lower lift cam profile. Further, spark may be advanced if engine speed decays more than desired.

Note that the throttle adjustments described in FIGS. 6A and 6B can be compensated for changes in altitude. For example, when transitioning between cam profiles at increased altitude, the throttle is opened further during changes from the higher lift cam profile to the lower lift profile. And, the throttle is closed less during changes from the lower lift cam profile to the higher lift cam profile.

As will be appreciated by one of ordinary skill in the art, the routines described in FIG. 4 may represent one or more of any number of processing strategies such as event-driven, interrupt-driven, multi-tasking, multi-threading, and the like. As such, various steps or functions illustrated may be performed in the sequence illustrated, in parallel, or in some cases omitted. Likewise, the order of processing is not necessarily required to achieve the objects, features and advantages described herein, but is provided for ease of illustration and description. Although not explicitly illustrated, one of ordinary skill in the art will recognize that one or more of the illustrated steps or functions may be repeatedly performed depending on the particular strategy being used.

This concludes the description. The reading of it by those skilled in the art would bring to mind many alterations and modifications without departing from the spirit and the scope of the description. For example, I3, I4, I5, V6, V8, V10, and V12 engines operating in natural gas, gasoline, or alternative fuel configurations could use the present description to advantage.

The invention claimed is:

1. A system for regulating flow to a cylinder of an internal combustion engine, the system comprising:

a valve operating mechanism capable of opening at least one intake valve at an opening position that is after top-dead-center, relative to an intake stroke of a cylinder, said intake valve opening position also being in advance of a closing of an exhaust valve in said cylinder;

a cam profile switching device that is capable of changing the amount of intake valve lift produced by said valve operating mechanism; and a controller constraining cam retard so that a desired level of manifold vacuum is observed when said cam profile switch is in a low lift position and when said valve operating mechanism is in a retarded position wherein the opening of said at least one intake valve is after top-dead-center, relative to the intake stroke of said cylinder, and where the opening of said at least one intake valve is in advance of the exhaust valve closing in said cylinder.

2. The system of claim 1 wherein said valve operating mechanism is an over-head rocker shaft valvetrain.

3. The system of claim 1 wherein said valve operating mechanism adjusts cam phase hydraulically.

4. The system of claim 1 wherein said cam profile switching device provides two levels of valve lift.

5. The system of claim 1 wherein said valve operating mechanism adjusts exhaust valve timing and intake valve timing in substantially equal amounts.

6. The system of claim 1 wherein said valve operating mechanism adjusts exhaust valve timing independent from adjustments to intake valve timing.

7. The system of claim 1 further comprising an intake valve mask.

8. A system for regulating flow to a cylinder of an internal combustion engine, the system comprising:

an electronically controlled throttle;

a variably operable valve mechanism capable of opening at least one intake valve at an opening position that is after top-dead-center, relative to an intake stroke of said cylinder, said intake valve opening position also being in advance of a closing of an exhaust valve in said cylinder;

a cam profile switching device that is capable of changing the amount of valve lift produced by said valve operating mechanism; and a controller to adjust throttle position, retard spark timing, and increase torque converter slip during a switching of said cam profile switching device from a low lift state to a high lift state when said variably operated valve mechanism is positioned such that said at least one intake valve opens after top-dead-center, relative to the intake stroke of said cylinder, and while said intake valve opening position being in advance of a closing of said exhaust valve.

9. The system of claim 8 further comprising a device to adjust engine spark advance.

10. The system of claim 8 wherein said intake valve opening is retarded to a range of between 0 and 45 degrees after top-dead-center of said intake stroke.

11. The system of claim 8 further comprising an intake valve mask, said valve mask and the position of said cam profile switch affecting the flow to said cylinder.

12. A method for regulating flow to a cylinder of an internal combustion engine, the method comprising:

retarding intake valve opening and exhaust valve closing to a crankshaft angle that is after top-dead-center, relative to an intake stroke of a cylinder, said intake valve opening position also being in advance of a closing of an exhaust valve in said cylinder;

varying the state of a cam profile switching device as engine speed varies and while said intake valve opening and said exhaust valve closing are retarded after top-dead-center, relative to said intake stroke; and constraining cam retard so that a desired level of intake manifold vacuum is observed while said intake valve opening is retarded from top-dead-center of the intake stroke of said cylinder.

13. The method of claim 12 wherein the spark advance of said cylinder is varied as the state of said cam profile switch varies.

14. The method of claim 12 wherein the throttle plate position of a throttle regulating flow into said engine is varied as the state of said cam profile switching device varies.

15. The method of claim 14 wherein the throttle plate position is changed to increase the throttle opening prior to said cam profile switch changing state.

16. The method of claim 14 wherein the throttle plate position is changed to decrease the throttle opening prior to said cam profile switch changing state.

17. The method of claim 13 wherein said spark advance is retarded in response to said cam profile switching device changing state.

18. The method of claim 12 further comprising varying the state of said cam profile switching device as the engine load demand varies.

19. The method of claim 12 further comprising injecting at least a portion of an injected fuel amount to said cylinder when said intake valve is open.

* * * * *